US005367310A

United States Patent [19]

Warnagiris

[11] Patent Number: 5,367,310

[45] Date of Patent: Nov. 22, 1994

[54] FIBER OPTIC ANTENNA RADIATION EFFICIENCY TUNER

[75] Inventor: Thomas J. Warnagiris, San Antonio, Tex.

[73] Assignee: Southwest Research Institute, San Antonio, Tex.

[21] Appl. No.: 775,035

[22] Filed: Oct. 11, 1991

[51] Int. Cl.[5] ..... H01Q 9/00

[52] U.S. Cl. ..... 343/745; 343/749; 333/262; 327/427; 327/365; 327/514

[58] Field of Search ..... 343/745, 749, 750, 759, 343/876; 333/103, 104, 262; 307/247.1, 571

[56] References Cited

U.S. PATENT DOCUMENTS

| | | | |
|---|---|---|---|
| 3,339,205 | 8/1967 | Smitka | 343/749 |
| 4,564,843 | 1/1986 | Cooper | 343/745 |
| 4,751,513 | 6/1988 | Daryoush et al. | 343/700 MS |
| 4,843,354 | 6/1989 | Fuller et al. | 333/362 |
| 4,920,285 | 4/1990 | Clark et al. | 307/571 |
| 4,924,238 | 5/1990 | Ploussios | 343/802 |
| 4,929,855 | 5/1990 | Ezzeddine | 333/104 |
| 4,939,525 | 7/1990 | Brunner | 343/745 |
| 5,159,297 | 10/1992 | Tateno | 333/104 |

*Primary Examiner*—Donald Hajec
*Assistant Examiner*—Tan Ho
*Attorney, Agent, or Firm*—Donald Gunn

[57] ABSTRACT

A system for switching an antenna formed of multiple connected segments is set forth. The various segments are connected together by a switch means having, in the preferred embodiment, one or more FETs; a gate controlled terminal is connected with a bias circuit which is biased on or off by a bias circuit triggered to switch by light. The light is coupled through an optical fiber which directs light onto a portion of the bias circuit to cause operation. The bias circuit preferably includes a photo voltaic cell.

13 Claims, 1 Drawing Sheet

FIG. 1
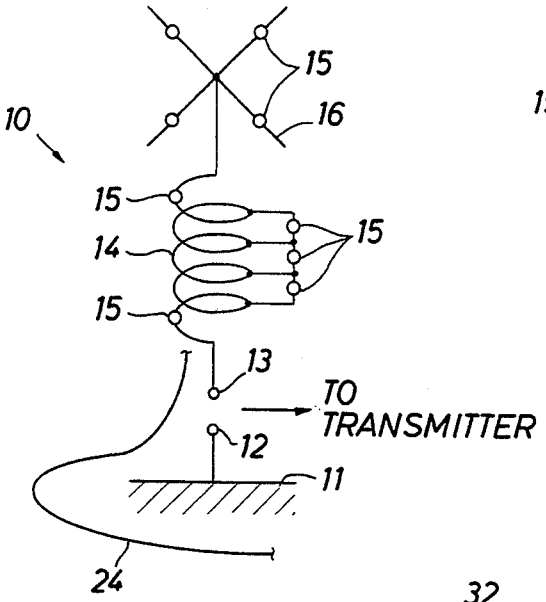
FIG. 2
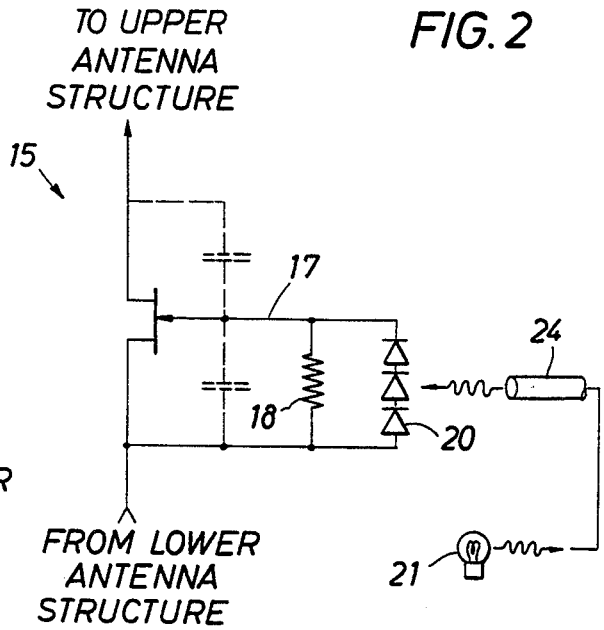
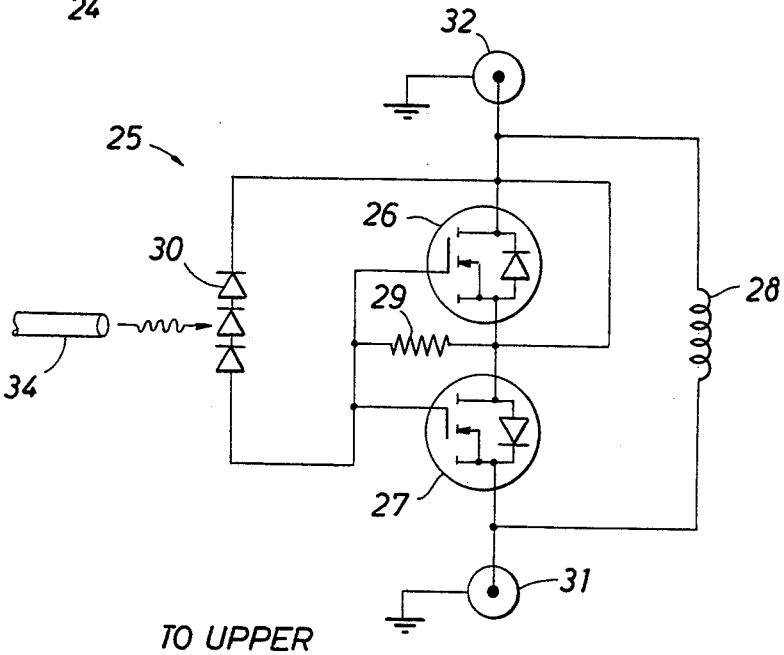
FIG. 3
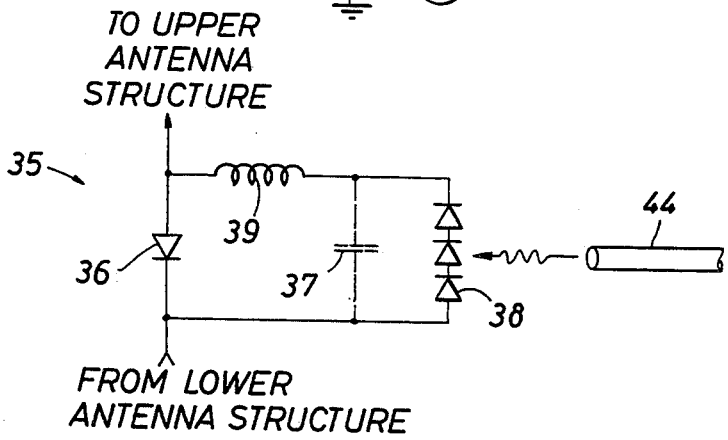
FIG. 4

FIBER OPTIC ANTENNA RADIATION EFFICIENCY TUNER

BACKGROUND OF THE DISCLOSURE

This disclosure is directed to a tuner useful in antennas. It particularly finds an application in an antenna system where it is physically not possible to display an antenna constructed to an optimum antenna length. As a generalization, it is desirable that an antenna have length which is some multiple of ¼ of the wavelength. At frequencies above 100MHz, this poses no particular problem because the wavelength is relatively short. This is a much more severe problem at lower frequencies, and it is particularly difficult below about 1MHz. Using that frequency as an example, a 1MHz vertically positioned quarter wavelength antenna requires a height of 75 meters to provide good radiation efficiency with an easily matched impedance in the coupling circuit. For the ham operator in the 10 meter band, antenna size is only then approaching that which can be readily handled.

As a generalization, deviation from multiples of a quarter wavelength and especially where the antenna length is significantly less than about one quarter of the wavelength, coupling problems arise. For one, there is more difficulty in matching the impedance with the coupling circuit. In addition to that, radiation efficiency is severely impacted. As another factor, the impedance looking into the antenna terminals becomes more reactive for antennas which are significantly less than one quarter wavelength. While it is possible to provide an impedance matching network connected between the transmitter and the antenna, those are not so easily implemented because there are relatively large currents or voltages involved, particularly where the transmission involves substantial power. One of the factors involved in antenna construction is the use of an antenna assembly which is formed of several serially connected sections. They are connected with some type of switch mechanism. The switches are used to either short or disconnect sections of the antenna. Those switches however normally require some type of switch control relay or other mechanism. This connects the switch as well as the switch control mechanism in the current flow power directed to the antenna assembled from one or multiple sections. It is of course important to isolate the power being delivered to the antenna to those operative sections which make up the antenna at the selected configuration; otherwise, the switch and switch control mechanisms may become activated in some sense with spurious radiation from the antenna system so that even a switch which has been switched off may become energized in an undesirable fashion.

Switch isolation can be obtained by placing RF chokes in the switch circuitry. This is not desirable because they interfere with the field resultant from the multiple sections of the circuitry making up the switched antenna. There is another problem too, namely the RF chokes create inductive fields which cannot be quickly switched. Further, such circuits involve control lines which are normally connected to the switches. The control lines themselves become active constitutents of the antenna even when this is not intended. In effect, they represent a circuit having continuity involved in the antenna elements and/or support structure. They are sources of parasitic field radiation.

Moreover, they are a source of leakage around such an open switch.

The present disclosure sets forth a system for handling this problem. This will be described in the context of an antenna system formed of multiple sections which operates at selected wavelengths. In that context, the antenna system will typically be operating at substantially less than the optimum quarter wavelength. Moreover, rapid antenna switching is accomplished by the structure of the present disclosure which particularly assists in holding down spurious radiation involving the switching and coupling circuits.

SUMMARY OF THE PRESENT DISCLOSURE

This disclosure sets out an antenna system which is formed of multiple sections which are serially connected together by means of switches. The several switches in conjunction with an antenna driving circuit define an antenna system which has radiation elements connected in the antenna system. Moreover this defines a system which is substantially shorter than the desired one quarter wavelength so that coupling is more difficult. At various locations, switches are installed in the antenna system. In accordance with the preferred embodiment, each switch utilizes switching devices such as field effect transistors (typically a MOS FET). The system can use one or more MOS FETs in an embodiment. In all instances, the system utilizes a fiber optic cable originating remote which delivers a photon control signal to operate a photo voltaic cell, thereby switching after the switch signal is applied by the cell (one or more) to the gate of the FET. The signal is delivered through a fiber optic cable which is formed of glass or plastic and which is wrapped with a non-metallic sleeve. The sleeve and fiber optic cable of glass or plastic do not pick up radiation from the antenna and do not become involved in spurious or parasitic radiation. Moreover, substantial resistance between the antenna sections at the switch is accomplished when it is open. Indeed, such isolation enables a high level of resistive isolation to be accomplished and does not involve the switch or switch control mechanisms making up the control mechanism in the antenna system. Greater details will be given along with an explanation of the mode of operation referring to the illustrated and preferred embodiments found below.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a schematic of an antenna system formed of multiple sections including a plurality of switches involved in the antenna system where the switches are operated in accordance with the teachings of the present disclosure;

FIG. 2 is a detailed schematic of one switch featuring a MOS FET operated in response to a photon signal transmitted through a fiber optic cable to photo voltaic cells;

FIG. 3 is a schematic of an alternate form of MOS FET operated switch further showing a shunt inductor which is resonant with the FET capacitance; and FIG. 4 is a schematic of a PIN diode cooperative with an RF choke and stray capacitance defining a resonant circuit which is switched on or off using a fiber optic cable.

DETAILED DESCRIPTION OF THE PREFERRED ILLUSTRATED EMBODIMENTS

Attention is now directed to FIG. 1 of the drawings where the numeral 10 identifies an antenna system. The antenna system is represented schematically. To this end, there is a ground 11 for the antenna system. The antenna system includes a lead connected from ground at 12 to a pair of terminals at 13. These terminals connect with a transmitter. The transmitter is capable of operating as an AM transmitter, or perhaps as a FM transmitter, or it may operate in the CW mode, or may be SSB; in fact, it can differ in so many circumstances, and it is sufficient to describe it as a transmitter operating at some frequency at any power level that is appropriate for the circumstances. The antenna system 10 is shown with a loading coil. The coil 14 incorporates multiple switches 15. Several such switches are located to short or open various turns of the coil. As will be understood, by appropriate selection of the switches that are opened or closed, the performance of the antenna system 10 is materially altered. Moreover, the antenna includes a radiation element, being one or more, and they are identified at 16. Again, the switching elements 15 are located at many places in the antenna system. As marked in FIG. 1, a representative antenna height is given at about three meters, or about ten feet. Moreover, at a frequency of 2MHz this is materially less than one quarter wavelength. The antenna system may include an upright support, or it may not; in the event that one is included, this is represented in FIG. 1 of the drawings as having a quarter wavelength height at thirty-two megahertz. Again, these dimensions and frequencies are relative, but they serve the purpose of pointing out the problem, namely that an optimal antenna system preferably operates at a quarter wavelength or multiples thereof, and an antenna system which is significantly less than one quarter wavelength poses problems in antenna coupling. These problems are believed to be well known and include difficulties in making an impedance match looking into the antenna; a fact which is known to those of average skill in the art. Accordingly, the antenna tower can be any kind of support structure and can be positioned in any suitable fashion. The antenna system can be omnidirectional or directional, and can have any kind of array of antenna elements. The key thing to note is that the antenna system incorporates several of the switching elements which are shown in FIG. 1. These switching elements are described at greater detail with reference to alternate embodiments found in FIGS. 2, 3 and 4.

Going now to FIG. 2 of the drawings, the numeral 15 identifies a switching element which is shown in that drawing. In this particular instance, the preferred switching element is a MOS FET as illustrated which is sufficiently sized to serve as an RF power switching element. The gate terminal 17 is provided with a gate voltage across a resistor 18. The resistor 18 is parallel with a photo voltaic cell 20, there being one or more such cells. In part, the number of cells depends on the voltage between the source and gate of the MOS FET 17 and bias applied to the gate. In dotted line, stray capacitance inherently involved in the MOS FET 17 is represented. This has the form of two capacitors, one being connected from the gate to the drain and the second to the source of the MOS FET 17. More importantly, the structure of FIG. 2 utilizes a fiber optic cable 24 which connects to the photo voltaic cells 20 for switching them. The fiber optic cable is connected to a light source which is located elsewhere. As shown in FIG. 2 of the drawings, a lamp 21 is incorporated to provide light through the fiber optic cable. As shown in FIG. 1 of the drawings, the fiber optic cable can run along or be physically supported on one or several components of the antenna system 10. Indeed, it can be immediately adjacent to or parallel to the antenna system. If it were made of metal, it would become involved in the antenna field and would be a source of parasitic loading at the least, and a source of parasitic radiation. It would also typically degrade the performance of the system at least in some measure. By utilizing a wrapped fiber optic cable, this is avoided.

The fiber optic cable is normally provided with a nonmetallic sleeve which protects it from the elements and is also formed of a glass or plastic fiber; all the components are non-metallic and do not become involved in the fields associated with the antenna system 10. For that reason, it can be positioned anywhere in the antenna system where support is provided. The fiber optic cable 24 therefore extends from a remote location where the lamp 21 is located. The lamp 21 is operated by providing suitable current to it to turn it on or turn it off. When turned on, it is able to provide light which is transferred by the cable 24 to the switch. The switch is operated to change the operative condition of the MOS FET 17. The MOS FET 17 is used as a switching device; that is, it is switched between conductive or blocking states. When it is switched off, it provides blocking of current flow between the drain and source. As will be observed in FIG. 1, the switch 15 of FIG. 2 is connected at some selected location in the antenna system 10. It is typically supported on the antenna structure as an appendage extending from the terminus of the fiber optic cable 24. Greater convenience is achieved by routing the optical fiber 24 along the antenna structure.

Attention is now directed to FIG. 3 of the drawings where the numeral 25 identifies an alternate embodiment. This particular embodiment incorporates serially connected MOS FETs 26 and 27. The two of them connected in series are arranged in parallel with a shunt inductor 28. There is a gate resistor 29 which develops a voltage providing a bias to the two MOS FETs 26 and 27. That is connected so that photo voltaic cells at 30 provide a switched controlled voltage for operation of the two transistors. As a generalization, the two transistors are provided with a common bias voltage from the resistor 29. Switching occurs when the optical fiber 34 is provided with an optic impulse at a frequency selected to operate the cell 30. This is one mechanism by which the transistors can be switched on to enable connection of the input and output. Briefly, there is an input by means of a suitable shielded cable connector 31 and a similar connector 32 is provided for the output of the switched RF current. RF current thus feeds through the connector 31 and is output at the connector 32. Current flow is directly through the serially connected FETs when they are switched for current flow. When they are switched off, there is the risk of current flow through the system utilizing the parasitic capacitance associated with the two transistors. This is prevented by the incorporation of the shunt inductor 28. It has a value which is selected to provide resonance with the FET capacitance at the frequency of the transmitter. Also, the stray capacitance of the FETs 26 and 27 provide equal and opposite signals, thus cancelling any spurious control signals. For instance, and using the example given before, assume that the frequency of interest is 1MHz. In that instance, the RF inductor is sized so that it achieves a resonant frequency at 1MHz. This approach can routinely be used to thereby cancel the prospective undesirable results arising from the stray capacitance inherent in use of the transistors.

The numeral 35 identifies another alternate embodiment. In this particular version, a blocking diode 36 prevents current flow to the antenna structure. The embodiment 35 incorporates an RF choke 34 having an inductance which achieves a resonant frequency with a capacitor 37. As before, the capacitor 37 derives from the accumulation of parasitic capacitors inherent in the construction of the system. The switch further includes one or more photo voltaic cells 38 which are controlled by a signal on a fiber optic cable 44. When a signal is provided on the optical fiber 44, the photo voltaic cells are switched. This changes the bias at the anode of the PIN diode 36 to permit or prevent current flow. The diode 36 is switched from a conducting state to a blocking state. As before, the size of the RF choke is adjusted to match the capacitor 37. These two are tuned to be resonant at the frequency of the transmitter.

The embodiments 15, 25 and 35 utilize long optical fibers which extend from a remote location. To put this in context, assume that the transmitter is located 200 feet from the antenna which is supported on a mast at some remote location. Assume further that twelve different switches are included in the antenna system. Assume further that the twelve switches have to be operated to configure the antenna in a particular fashion. Assume further that the antenna is operative in the frequency range of one to about 5 MHz, and provides a power output of one kilowatt. Assume further that this power requires an antenna current in excess of five amperes. Assume also that the twelve switches are operated by personnel at the transmitter and the twelve switches therefore require control cables extending from the transmitter facility along the antenna coupling lines extending to the antenna from the transmitter. In the foregoing instance, it would be quite difficult to arrange the control lines for the dozen or so switches except through the use of the present disclosure. In other words, the twelve switches would require twelve conductors which are routed along with the antenna feed lines from the transmitter output amplifier to the terminals 13 at the transmitter. This would inevitably involve the twelve control lines in operation albeit in an undesirable fashion.

Through the use of the present disclosure, the fiber optic cables are extended to the antenna with impunity to involvement in the circuitry of the transmitter system. The twelve switches in the antenna system are configured by switching them off or on as required. This is achieved merely by illumination of a bulb or other light source such as the lamp 21 which is located remote from the switch, and an optical signal is then transferred to the appropriate switch. The switches are then operated, and the antenna system is configured substantially instantaneously. Transmission, of course, can begin even before the switches are opened or closed. Antenna radiation occurs in the fashion determined by the configuration of the switches in the antenna system. Assume, for purposes of description, that a switching sequence occurs where several of the switches are changed, and then changed back to the original state of affairs. This can be carried out in simple fashion. It is accomplished simply by changing the operation of lamps 21 located at the control apparatus for the twelve switches. The twelve are then operated again and again with various antenna switching sequences, and this can be carried out without creating parasitic oscillations or otherwise involving the switching circuitry in the antenna system. In other words, the antenna system is permitted to operate without any kind of parasitic involvement with the control lines 24 which extend to the various switches and switch control lamps as exemplified in FIG. 2.

Going now to the details of installation, each of the switches at 15, 25 and 35 can be mounted as a separate structure typically by encapsulation in epoxy resin or other material to make the device impervious to inclement weather. The fiber 24 extends into the encapsulation structure and the tip of it can be positioned in near proximity to the responsive cells so that the light is able to fall on the appropriate cells. Such an encapsulated structure markedly reduces the complexity of the device and, moreover, furnishes a readily installed switch which is relatively small and yet which can be mounted structurally supported by the antenna elements. In like fashion, the fiber optic cable 24 can be routed along or on the structure which comprises the sections of the antenna system, the mast on which it is supported, and also on the cables connected with the antenna terminals 13 which are driven by the output amplifier stage of the transmitter. There is no difficulty in accomplishing this arrangement.

While the foregoing is directed to the preferred embodiment, the scope thereof is determined by the claims which follow.

What is claimed is:

1. A method of controllably switching sections of an antenna system wherein a transmitter output stage is connected by a cable extending to a pair of input terminals for the antenna system and the antenna system is formed of deployed multiple sections, and the multiple sections of the antenna are arranged to provide a suitable height for transmission in a selected antenna radiation pattern, and the method of controlling the antenna section configuration comprises the steps of:

(a) positioning at least two antenna switch means between sections of the antenna selectively communicated for operating as an antenna system wherein said antenna switch means are separately located at two or more locations in the antenna system and are switched so that connections by said antenna switch means enables operation of the antenna as an antenna system, each antenna switch means comprising:

(i) a pair of field effect transistors coupled in series at a common node, the source of each transistor or the drain of each transistor connected to the node, (ii) a two-terminal photovoltaic cell coupled at one terminal to the node and at the other terminal to a common bias resistor coupled to the node, and (iii) a shunt inductor in parallel with the series combination of transistors with an inductance selected to provide a preselected resonant frequency with the inherent parasitic capacitance of the transistors;

(b) forming antenna switch signals for said antenna switch means at a location remote from said antenna switch means;

(c) transferring said antenna switch signals from said remote location at which said antenna switch signals are formed to an antenna switch means by conducting the signals along optical fibers extending from said remote location to said antenna switch means; and (d) applying said antenna switch signals to the antenna switch means for repetitive operation thereof.

2. The method of claim 1 including the step of initially positioning an optical fiber from the remote location to connect with said photovoltaic cell at said antenna switch means.

3. The method of claim 2 including the step of positioning the end of the optical fiber to deliver light transmitted through the optical fiber to said antenna switch means wherein the light causes operation of said antenna switch means.

4. The method of claim 1 including the step of operating said antenna switch means as a three terminal circuit having switchable connected input and output terminals and a gate terminal, and wherein a gating control voltage is applied to said gate terminal thereof.

5. The method of claim 4 including the step of initially positioning an optical fiber from the remote location to connect with said photovoltaic said at said antenna switch means.

6. The method of claim 5 including the step of positioning the end of the optical fiber to deliver light transmitted through the optical fiber to said switch means wherein the light causes operation of said antenna switch means.

7. The method of claim 6 including the step of sizing an said inductor to resonate at the transmitter frequency when connected to said antenna switch means parasitic capacitance.

8. The method of claim 6 including the step of positioning multiple optical fibers along the antenna system to control a like number of antenna switch means.

9. A switch for controlling adjacent sections of an antenna system which is divided into two or more sections wherein said switch is connected between the two sections and wherein said switch comprises a three terminal solid state switching device, and has input and output terminals which are connected for switching manner, and said input and output terminals are connected to adjacent antenna sections, and wherein a third terminal is a gate terminal; bias circuit means for defining an operative state of said gate terminal to trigger switching, and wherein said bias means includes means for receiving a signal thereto free of interaction with the electromagnetic field of the antenna, the switch including:

(a) a pair of field effect transistors coupled in series at a common node, the source of each transistor or the drain of each transistor connected to the node, (b) a two-terminal photovoltaic cell coupled at one terminal to the node and at the other terminal to a common bias resistor coupled to the node, and (c) a shunt inductor in parallel with the series combination of transistors with an inductance selected to provide a preselected resonant frequency with the inherent parasitic capacitance of the transistors.

10. The apparatus of claim 9 including an elongate optical fiber having a distal end positioned at means forming light to be transferred by said fiber, and said photovoltaic cell responsive to said light to change the operative state of said switch at said gate terminal.

11. The apparatus of claim 10 wherein said responsive means includes a solid state means responsive to light.

12. The apparatus of claim 11 wherein optical fiber comprises an elongate non-metallic optical fiber supported on the antenna system.

13. The apparatus of claim 12 including N switches and N optical fibers connected to each of said switches and where N is a whole number integer greater than two.

* * * * *